United States Patent [19]

Kuchenbecker et al.

[11] Patent Number: 4,951,824

[45] Date of Patent: Aug. 28, 1990

[54] CARTON HAVING AN OPENING FEATURE AND A CARTON BLANK

[75] Inventors: Morris W. Kuchenbecker, Neenah, Wis.; Steven J. Block, Augusta, Mich.

[73] Assignee: James River Corporation, Richmond, Va.

[21] Appl. No.: 351,032

[22] Filed: May 12, 1989

[51] Int. Cl.[5] ..... B65D 5/54

[52] U.S. Cl. ..... 206/625; 206/621; 206/628; 229/DIG. 4; 493/59; 493/160

[58] Field of Search ..... 206/611, 620, 621, 625, 206/628, 631, 631.1, 634; 493/59, 61, 160, 161, 396; 229/DIG. 4

[56] References Cited

U.S. PATENT DOCUMENTS

| | | | |
|---|---|---|---|
| 416,115 | 11/1889 | Mayall | 229/DIG. 4 |
| 1,362,330 | 12/1920 | Lange | 229/DIG. 4 |
| 1,482,569 | 2/1924 | Lange | 229/DIG. 4 |
| 1,550,033 | 8/1925 | Lange | 229/DIG. 4 |
| 1,789,105 | 1/1931 | Lange | 229/DIG. 4 |
| 2,458,867 | 1/1949 | Messersmith | 493/59 |
| 2,655,844 | 10/1953 | Sillars | 493/61 |
| 2,661,947 | 12/1953 | Reynolds | 493/161 |
| 2,949,066 | 8/1960 | Bombard | 493/161 |
| 3,097,785 | 7/1963 | Meyers | 206/628 |
| 3,163,095 | 12/1964 | Sheeran | 493/61 |
| 3,167,238 | 1/1965 | Smith | 206/628 |
| 3,301,391 | 1/1967 | Guyer | 206/628 |
| 3,399,820 | 9/1966 | Foster et al. | 229/37 |
| 3,463,039 | 8/1969 | Silver | 493/61 |
| 3,580,466 | 5/1971 | Thelen | 206/625 |
| 3,958,748 | 5/1976 | Smith et al. | 206/621 |
| 3,964,671 | 6/1976 | Steel | 206/628 |
| 4,043,503 | 8/1977 | Meyers et al. | 206/625 |
| 4,613,046 | 9/1986 | Kuchenbecker | 206/622 |
| 4,687,104 | 8/1987 | Ielmini | 206/607 |
| 4,746,109 | 5/1988 | Bar et al. | 270/95 |

FOREIGN PATENT DOCUMENTS

| | | | |
|---|---|---|---|
| 2149850 | 6/1972 | Fed. Rep. of Germany | 229/DIG. 4 |

*Primary Examiner*—Gary E. Elkins

*Attorney, Agent, or Firm*—Sixbey, Friedman, Leedom & Ferguson

[57] ABSTRACT

A paperboard carton blank consisting of a first panel having side walls connected thereto by scored fold lines formed between a respective side wall and a respective edge of the first panel is provided. The blank further includes a second panel having side walls connected thereto by scored fold lines formed between a respective side wall and a respective edge of the second panel with one of the side walls of the first panel and one of the side walls of the second panel being congruent. The second panel additionally includes a region of weakness formed therein for allowing access to the interior of a formed carton. This region of weakness includes a tab extending from the second panel, at least one uncut line of weakness formed in the second panel and at least one cut line of weakness substantially parallel to the uncut line of weakness and formed in the second panel.

The carton blank of this type is then used to form a paperboard carton having an opening feature which allows ready access to the contents of the carton. The opening feature preferably includes a pair of regions of weakness which cooperate to form an opening flap when desired. Each pair of regions of weakness include one uncut line of weakness and one cut line of weakness with the uncut lines being formed between the cut lines with each being formed in the external surface of the carton wall.

36 Claims, 7 Drawing Sheets

CARTON HAVING AN OPENING FEATURE AND A CARTON BLANK

BACKGROUND OF THE INVENTION

1. Technical Field

The present invention relates to a carton blank for forming a carton, and a carton which is to be filled with a consumable product accessible through an opening in the carton. More particularly, the invention pertains to an opening feature formed in a top panel of the carton which provides a reliable and a consistent opening when opened by the consumer.

2. Background Art

Paperboard cartons have been manufactured with a variety of opening features which allow the consumer access to the contents of the cartons. These features may consist of perforations, herringbone cuts, adhesive weaknesses, as well as other means of providing a point along the top panel, side panel or hinge lines where the carton may be most readily opened. A further opening feature commonly employed in cartons of this type is that of double-cut scores, as shown in U.S. Pat. No. 3,399,820 to Foster et al.

The above-mentioned opening feature is formed by way of double-cut scores, i.e. an inner and outer cut in the paperboard which extend at least halfway through the paperboard and which run parallel to one another. By so providing these cut score lines, when the consumer applies an upward force or opening force on the pull tab provided between the pairs of cut score lines, ply separation occurs in the regions between the inner and outer cut score lines. Continued pulling of the pull tab causes complete separation of the opening flap to allow the consumer unobstructed access to the contents of the carton.

Similar opening features are disclosed in U.S. Pat. No. 4,746,109 to Prater and U.S. Pat. No. 4,613,046 To Kuchenbecker. As in the above-mentioned patent, a point of weakness is provided in a panel of a respective carton where ply separation of the panel is permitted to occur when the consumer applies an opening force to the pull tab. The ply separation occurs between two pairs of reverse cut lines which are formed at least halfway through the panel of the carton. However, when forming the paperboard blanks which are to be later used in erecting the cartons disclosed, it is extremely difficult to accurately achieve the desired extent of the cut lines in both the top and bottom cut. These paperboard blanks are formed in a matrix which consists of a plurality of forming dies and counters. Because the paperboard must be cut on both sides thereof to form the double or reverse cuts, an extensive alignment procedure must be undertaken to assure that each cut formed in each side of each paperboard blank of the matrix is properly formed. Further, by cutting through both sides of the paperboard carton, the barrier which may have previously existed due to the various coatings provided on the paperboard is reduced. By cutting into both sides of the paperboard, there is left only the plies of the paperboard which are not impervious to moisture and subsequently cannot prevent the wicking of moisture into and out of the carton.

U.S. Pat. No. 4,687,104 to Ielmini discloses a similar carton and carton blank having score lines formed in the outer and inner surfaces of the top and the front flap. These score lines are referred to as extending partially through the outer and inner surfaces of the carton and carton blank. Given this assertion, the carton formed by the reverse score lines of U.S. Pat. No. 4,687,104 is no more reliable than the cartons set forth above. These cartons, as explained above, are difficult to manufacture due to variations in the depths of the die cut score lines which are experienced during their formation and which are difficult to control. Consequently, the resulting carton will not open as prescribed and may allow the ingress and egress of moisture to and from the carton.

As can be seen from the foregoing, there is clearly a pressing need for a carton of the above-mentioned type which will provide a reliable, and easy opening feature that is capable of opening with ease by the consumer, which will resist the infiltration of moisture and which will not retard the structural integrity of the carton when opened.

SUMMARY OF THE INVENTION

It is an object of the subject invention to overcome the deficiencies of the prior art. In particular, it is an object of the present invention to provide a carton having a reliable opening feature which is capable of opening smoothly without retarding the structural integrity of the carton.

It is another object of the subject invention to provide a paperboard blank for forming a carton having an opening feature wherein the cut and score lines may be readily controlled during the manufacture of the paperboard blank.

Yet another object of the present invention is to provide a carton in which the consumer may freeze and heat or cook the contents while in the carton, as well as consume the food contained therein directly from the carton. The user is then capable of readily gaining access to the contents of the carton without destroying the structural integrity of the container.

An additional object of the present invention is to provide a reliable opening feature which forms a moisture or other liquid or gas barrier between the environment and the contents of the carton and which resists the ingress and egress of moisture or other liquids or gases to and from the carton.

A further object of the present invention is to provide a reliable opening feature wherein during the opening of the carton, stress concentrations are formed at a predetermined point to produce uniform delamination of the paperboard at that predetermined point.

Yet another object of the present invention is to provide a method of forming a line of weakness in a paperboard blank or carton encompassing the reliable opening feature.

These, as well as various additional objects and advantages of the subject invention are achieved by producing a paperboard carton blank consisting of a first panel having side walls connected thereto by scored fold lines formed between a respective side wall and a respective edge of the first panel. A second panel is provided having side walls connected thereto by scored fold lines formed between a respective side wall and a respective edge of the second panel with one of the side walls of the first panel and one of the side walls of the second panel being congruent. The second panel further includes an opening means formed therein for allowing access to the interior of a formed carton. This opening means includes a tab extending from the second panel, at least one uncut line of weakness formed in the second panel and at least one cut line of weakness substantially parallel to the uncut line of weakness and formed in the second panel.

This carton blank is then used to form a paperboard carton having an opening feature which allows ready access to the contents of the carton. The opening feature preferably includes a pair of opening means which cooperate to form an opening flap when desired. Each pair of opening means includes one uncut line of weakness and one cut line of weakness with the uncut lines being formed between the cut lines on the external surface of the carton wall.

Additional advantages of the subject invention will become apparent from the figures and the following description of the preferred embodiment.

DETAILED DESCRIPTION OF THE PREFERRED EMBODIMENTS

Figure 1:
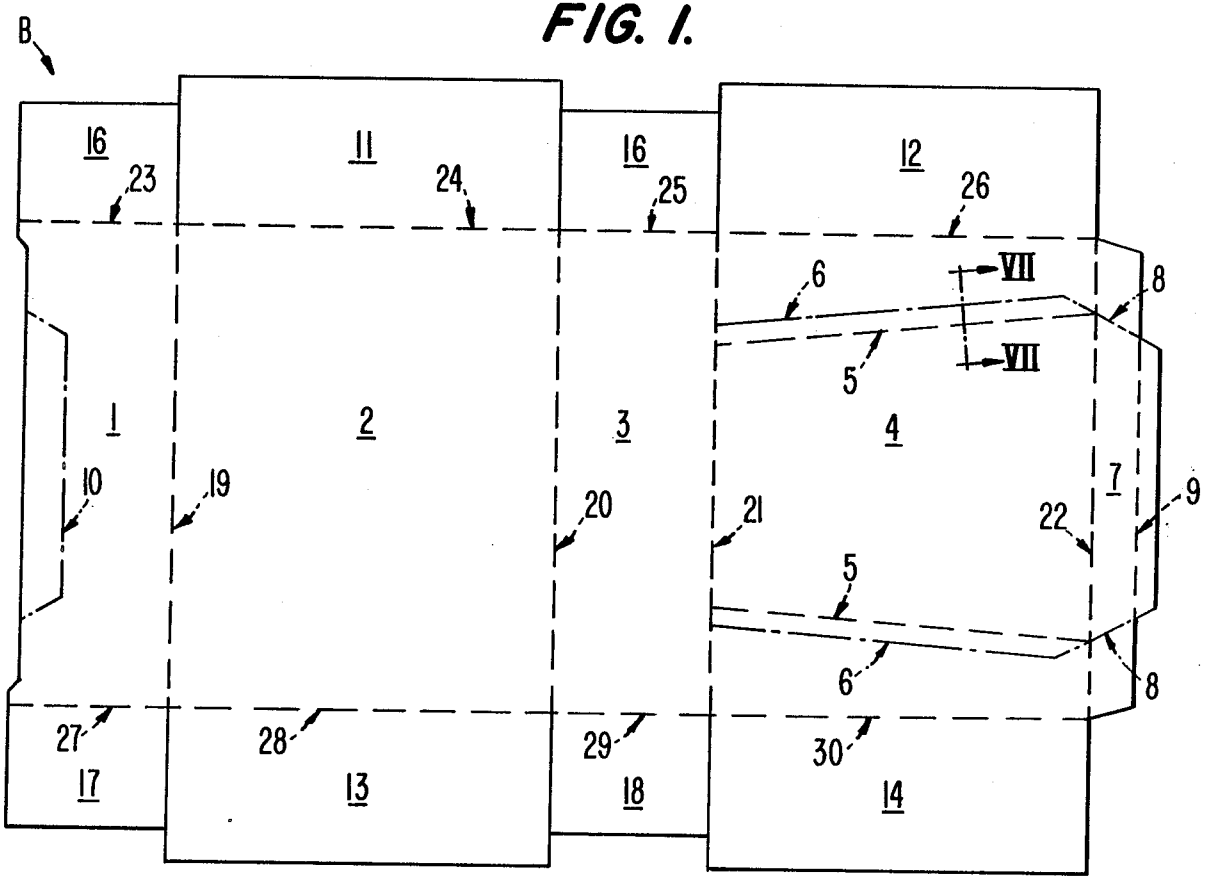
FIG. 1 is a top view of the paperboard carton blank used in forming the carton in accordance with a preferred embodiment of the invention.
Figure 2:
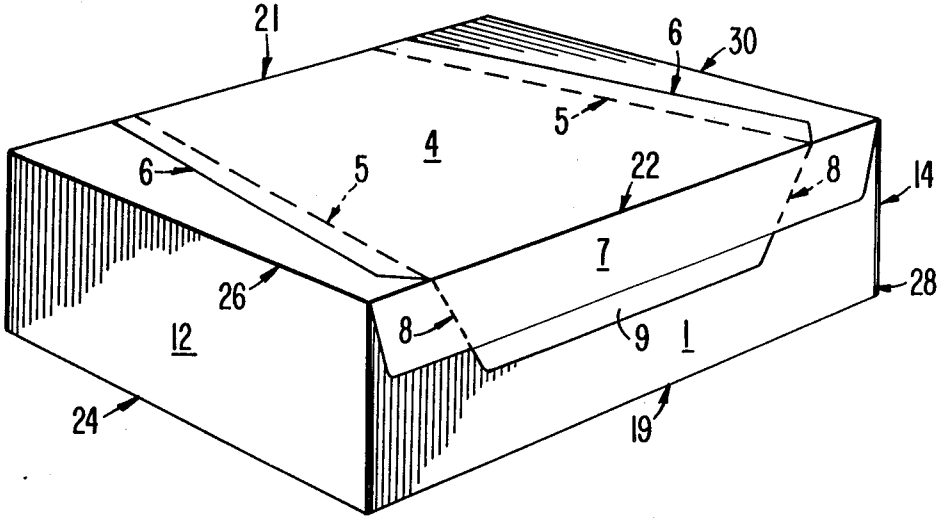
FIG. 2 is a perspective view of the paperboard carton in accordance with a preferred embodiment of the invention carton in its closed condition.
Figure 4:
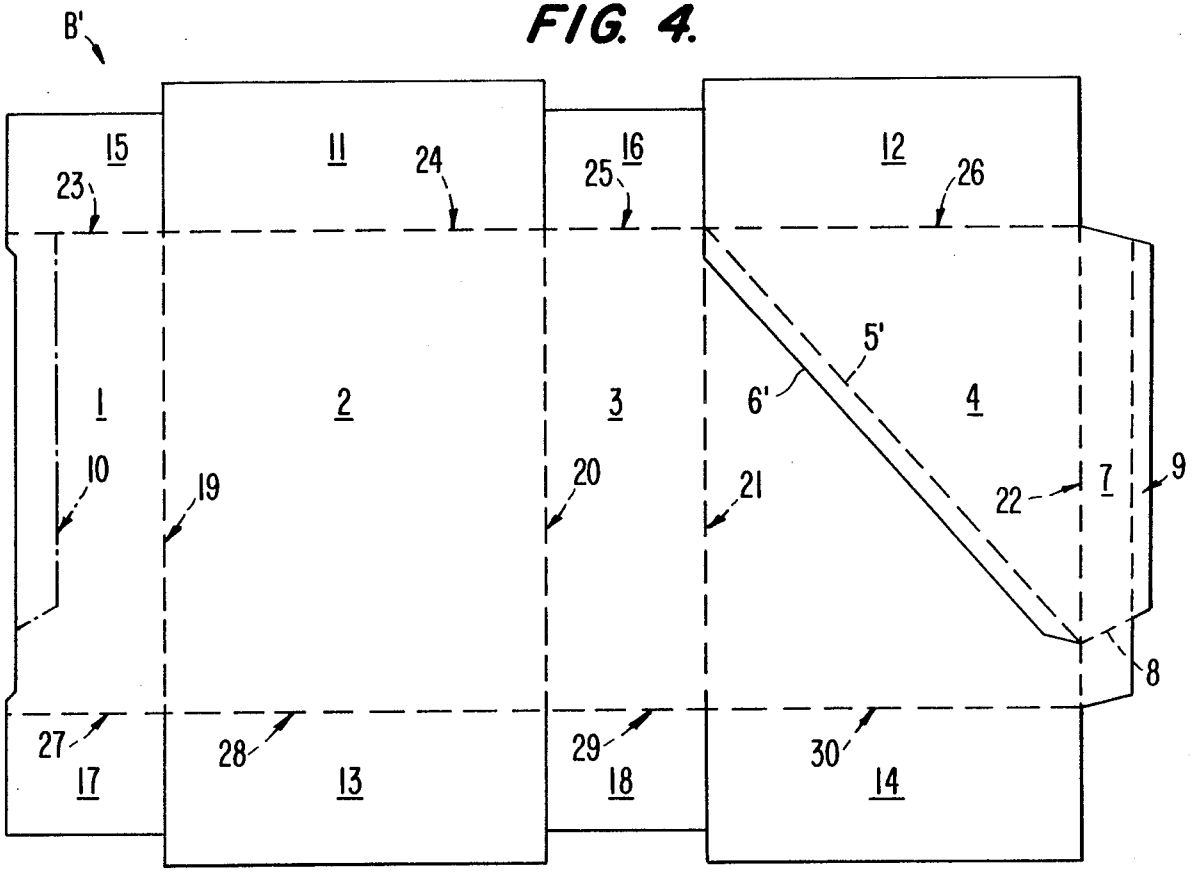
FIG. 4 is a top view of the paperboard carton blank used in forming the carton in accordance with an alternative embodiment of the invention.
Figure 5:
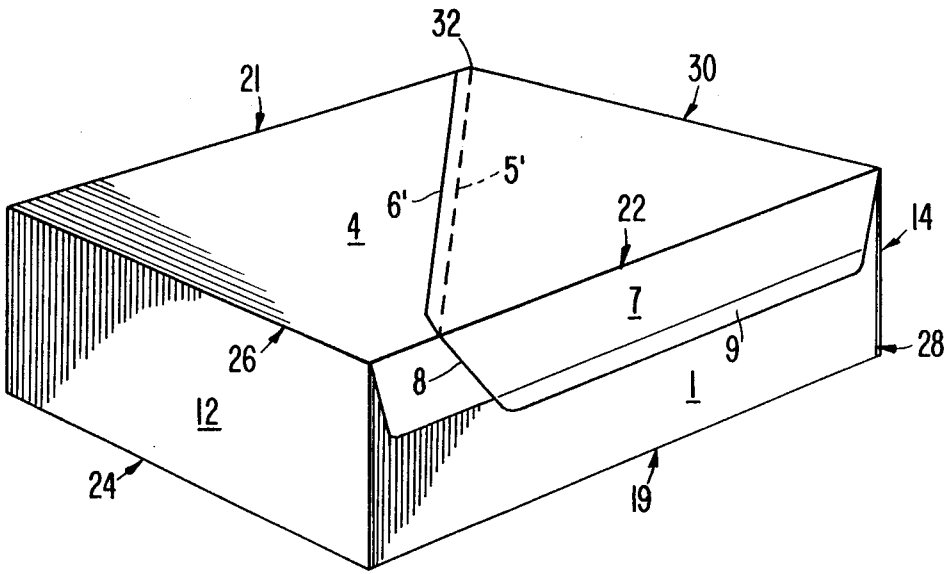
FIG. 5 is a perspective view of the paperboard carton in accordance with the alternative embodiment of the invention in its closed condition.

Referring now to FIGS. 1 and 4, there is shown a carton blank for forming each of the cartons set forth in FIGS. 2 and 5. The carton blanks B and B′ of FIGS. 1 and 4 each comprise a front panel 1, a bottom panel 2, a back panel 3 and a top panel 4. Like numerals will be used to designate like parts in each of the embodiments illustrated. The bottom panel 2 is flanked on either side by side walls 11 and 13 while top panel 4 is flanked on either side by side walls 12 and 14. The front panel 1 and rear panel 3 are likewise flanked by side walls 15 and 17, 16 and 18, respectively, which when constructed cooperate to form the end closures of the finished carton. The carton blanks B and B′ are formed of a paperboard material. This paperboard material may be coated with polyethylene or other barrier materials. These materials may also be chosen to be suitable for use in a microwave oven. Those skilled in the art will certainly appreciate that the coating selected will depend directly on the intended use of the resulting carton.

Each of the panels 1, 2, 3 and 4 and the side walls 11–18 are hingedly connected to one another by way of score lines 19–30. By providing such score lines the carton blanks can be readily formed into the cartons illustrated in FIGS. 2, 3, 5 and 6. Hingedly connected to the top panel 4 by way of score line 22 is a tear flap 7. The tear flap 7 additionally includes a lift tab 9 which may be readily grasped and drawn upward by the consumer to break away the tear flap 7 at the release area 10. The release area 10 is provided by forming a cut score line in the front panel 1 which allows a ply separation to occur in the release area 10 due to the pulling action of the consumer. The release area 10 allows the tear flap 7 to break away at the perforated lines of weakness 8. This feature will be further discussed below with regard to the open containers.

Figure 7:
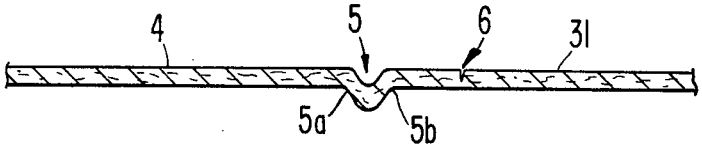
FIG. 7 is a cross-section view of the region of weakness taken along lines VII—VII of FIG. 1.
Figure 8:
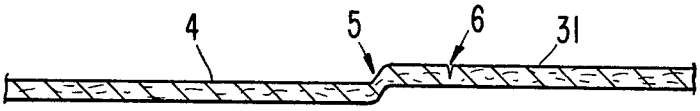
FIG. 8 is an alternative cross-section of the region of weakness of FIG. 7.

Illustrated in FIG. 1 is a pair of inwardly tapering sharp and narrow crease lines or embossed lines 5 which are positioned inward of and parallel to a cut score line 6. These features are similarly illustrated in FIG. 4 by the narrow creased lines or embossed lines 5′ and the cut score line 6′. As is illustrated in FIGS. 7 and 8, the cut score line 6 is cut into an upper or outer surface 31 of the top panel 4. The cut score line 6 can be cut 5% to 80% of the way through the thickness of the top panel; however, a depth of approximately one-half of the thickness of the paperboard is preferred. This cut score line being similar to those discussed in the prior art above. The crease line or embossed line 5 is formed in the upper surface or outer surface 31 of the top panel 4 and forms the inner line of weakness in the finished container.

Figure 9:
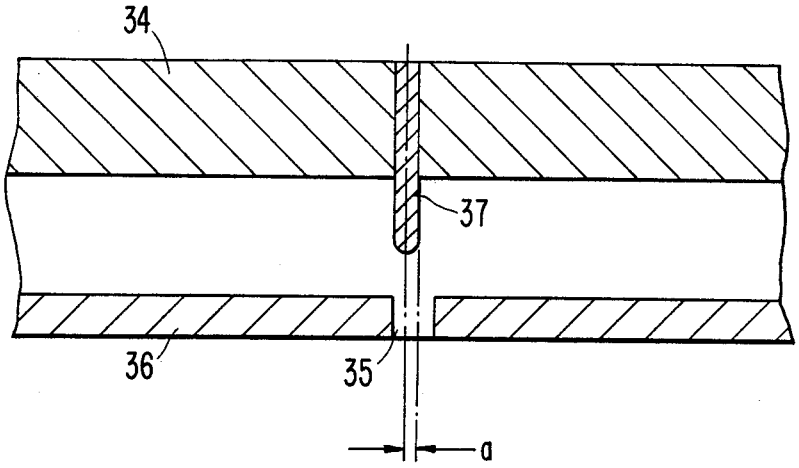
FIG. 9 is a cross-section view illustrating the offset nature of the crease rule and crease channel in accordance with preferred embodiment of the invention.

During the manufacture of the sharp narrow crease line 5, a die 34 having a crease rule 37 forms the crease line within a crease channel 35 cut into what is known as the counter 36 for forming the paperboard carton blanks of this type. In accordance with the preferred embodiment of the invention, the crease rule 37 is offset inwardly toward the center of the top panel 4 a distance "a" such that the inner edge **5*a* of the crease score line 5 is pinched to a greater degree than that of the outer edge 5*b* of the crease score line 5. This offset of the die 34 relative to the counter 36 is illustrated in FIG. 9. The amount the offset "a" is directly dependent upon the type and thickness of paperboard material to be formed into the resulting carton as well as the ultimate use of the resultant carton. For example, when a paperboard blank of 0.014 inches in thickness is to be manufactured, the crease channel 35 cut in the counter 36 used in forming the crease lines and fold lines would be approximately 0.032 inches wide. When forming the sharp narrow crease lines 5 in the paperboard material, the crease channel 35 may be centered relative to the crease rule 37 of the cooperating die 34; however, as discussed above, it has been found that a sharper and more reliable tear edge is evident if the crease rule 37 is offset inwardly the distance "a" from the center line of the crease channel 35**. In the case of the 0.014 caliber paperboard material set forth above, an offset "a" in the range of 0.002 to 0.005 inches is adequate for producing the necessary and proper sharper tear edge.

By forming the uncut crease score line 5 in an offset manner, a clear tear is observed on the inner surface of the top panel when the carton is opened. The particular degree of offset "a" is determined by the caliber of paperboard material used the thickness of any coatings or foils placed on the paperboard and the ultimate use of the paperboard material.

The embossed line 5 illustrated in FIG. 8 is formed in a conventional manner using embossing plates in order to form the uncut line of weakness in the carton blank. The embossing plates are positioned in such a manner that a similar pinching action occurs when forming the embossed line 5 such that the embossed line performs a similar function to that of the creased line. As shown in FIG. 8, the top panel 4 is depressed by the embossing procedure; however, this surface may be raised rather than depressed and result in an equivalent line of weakness.

Turning now to FIGS. 2 and 5, the carton blanks are illustrated in their erect condition and have been preferably filled prior to the final sealing of either the end flaps or the top panel forming the finished product. As can be noted, the carton of FIG. 2 includes a pair of weakness regions formed by the uncut crease score lines 5 and the cut score lines 6, while in the carton of FIG. 5, there is only a single region of weakness formed by the uncut crease score line 5′ and the cut score line 6′. As can be seen from these figures, the regions of weakness extend from the front edge 22 of the top panel 4 to the rear edge 21 of the top panel 4. Also, it should be noted that the regions of weakness in FIG. 2 converge toward one another from the front edge 22 to the rear edge 21 of top panel 4. In doing so, this inward taper continuously causes stress concentrations at the regions of weakness during the opening of the carton that result in uniform ply separation between the uncut crease score lines of weakness 5 and the cut score lines of weakness 6 such that the resultant carton opens evenly and cleanly at the predetermined region of weakness.

Figure 3:
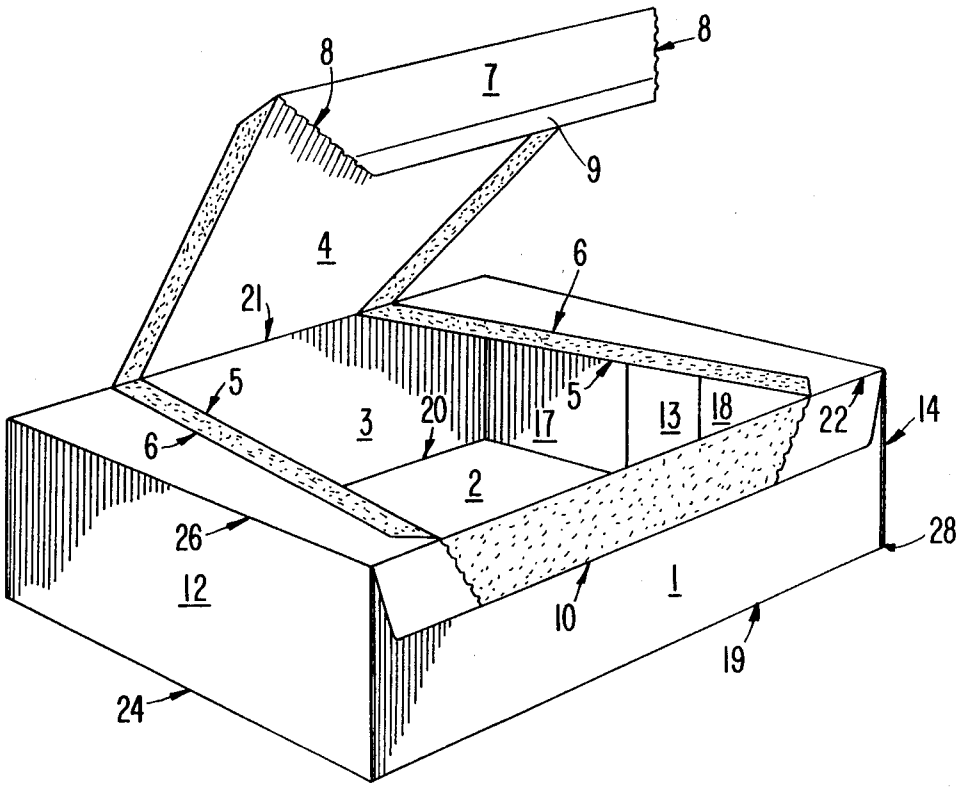
FIG. 3 is a perspective view of the carton of FIG. 2 in its open condition.
Figure 6:
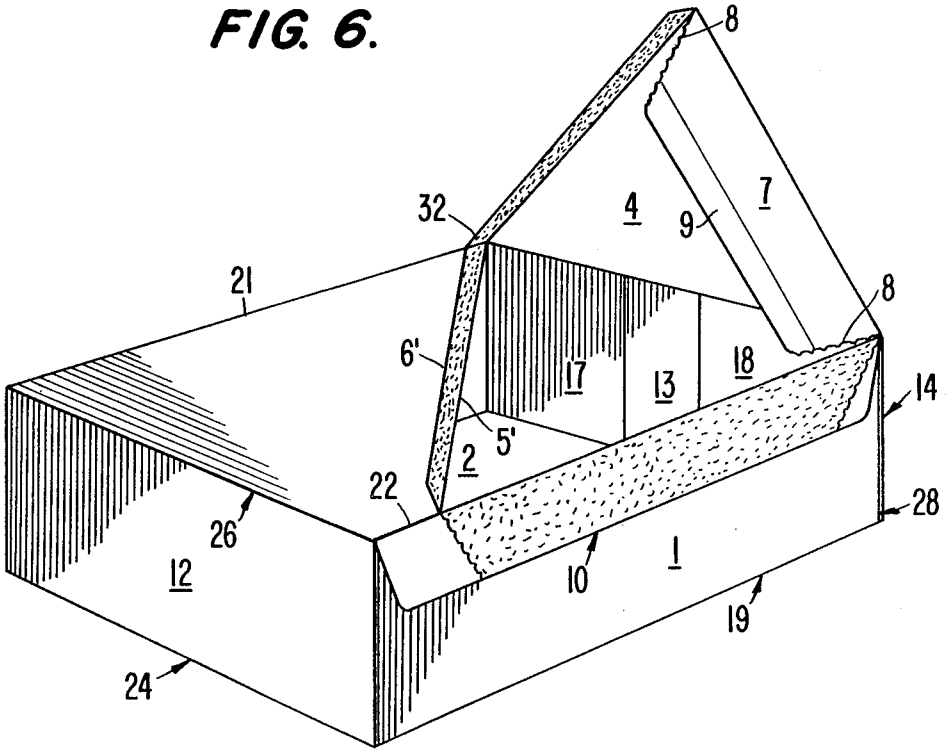
FIG. 6 is a perspective view of the carton of FIG. 5 is its open condition.

As mentioned above, to open the container the user will grasp the lift tab 9 and pull upwardly thereon, at which time the perforated lines of weakness 8 will tear and a cut scored release area 10 will ply separate thereby releasing the tear flap 7. Once this is accomplished a continued upward force on the lift tab 9 by the consumer will cause ply separation between the lines of weakness 5 and 6 or 5′ and 6′ of the carton which will allow the consumer to open the carton as illustrated in FIGS. 3 and 6.

Because the inner line of weakness 5 of the container is that of an uncut score line or embossed line formed in the external surface of the carton, and the cut score line of weakness is also formed in the external surface of the carton, a moisture or other liquid or gas barrier is maintained between the environment and the contents of the carton. Paperboard material, by its nature is porous and pervious to moisture as well as other liquids or gases. By coating the paperboard material with a liquid or gas barrier coating, a carton formed of such coated paperboard material will form a barrier between the contents of the carton and the environment, thereby minimizing both the effect of loss of components of the contents to the environment and the effect of transfer of moisture or other liquids or gases from the environment to the contents. When double-cut or reverse-cut score lines are used, this moisture barrier is destroyed because the cut score lines cut through the coating material and into the paperboard. Consequently, the only barrier between the contents of the carton and the environment is that of the previous plies of the paperboard which will not resist moisture or other liquids or gases.

With the carton of the present invention, there is no cut in the inner surface of the paperboard material and subsequently the destruction of the barrier that may be provided on the inside surface through coatings or other means can be minimized while a clean separation of the top surface 31 of top panel 4 is obtained. Consequently, the structural integrity of the carton is unobstructed and a highly controlled ply separation occurs in the regions of weakness. These favorable results are obtained while affording a simpler and more cost effective method of manufacture.

The nature of the offset may be varied depending upon the ultimate use of the resultant container. If the manufacturer is primarily concerned with providing a reliable opening feature, the offset "a" would be maintained at its greatest extent thereby providing a smooth and uniform opening feature. However, due to the pinching characteristics of the offset, the moisture barrier may be damaged. If this barrier is not of concern for the particular use of the carton, then no further treatment of the formed blank is necessary. If the barrier is necessary, The manufacturer may either reduce the offset to a value which does not destroy the barrier or apply a moisture-proof coating to the formed paperboard blank. Therefore, as noted above, the offset "a" of the uncut sharp crease score line 5 may be varied so as to form a carton blank within the desired specifications of the user.

The carton of FIGS. 5 and 6 illustrates an additional embodiment of the present invention. As discussed above, the carton includes only one region of weakness which extends from the front edge 22 of the top panel 4 to the rear edge 21 of the top panel 4, as in the carton of FIGS. 2 and 3. It should be noted that this region of weakness extends to a rear corner 32 of the carton; however, such is not required in that a further ply separation may be provided along fold line 21 between the top panel 4 and the rear panel 3 such that the region of weakness will extend across the top panel 4 and subsequently along the fold line 21 to the corner 32 of the carton. Therefore, when the consumer draws upwardly on the lift tab 9, the tear flap 7 will release at the cut score release area 10 as mentioned previously, and ply separation will occur between the lines of weakness 5′ and 6′ thereby allowing the carton to be conveniently opened by the consumer.

The above described cut and uncut score lines provide for the smooth and reliable opening of the carton. Further, the costs and complications associated with the manufacture of the blanks for forming such cartons has been significantly reduced as compared to the double cut or reverse cut score openings. As mentioned previously, the formation of the blanks of the prior art is both costly and requires painstaking hours of preparation, and even with such preparation a significant number of the opening features of the formed cartons fail because the reverse-cut score lines have not been properly formed. As can be noted from FIGS. 7 and 8, both the uncut score line and the cut score line are formed from and into the upper surface 31 of top panel 4. This relieves the manufacturer of attempting to align two separate cut score lines which must be formed in both an upper and lower surface of the paperboard blank. In doing so, the cost to manufacture as well as the reliability of manufacture are significantly reduced when forming the carton blank and carton in accordance with the present invention.

While the invention has been described in connection with a carton of the above-mentioned type, the disclosed opening feature may be presented on any type carton where it is desired to have an opening mechanism which allows ready access to the contents of the carton. Further, the panels and side walls of the present invention may take any configuration and that configuration disclosed is only exemplary of the application of the opening feature of the present invention.

The foregoing is a description of illustrative embodiments of the invention, and those skilled in the art will appreciate that numerous modifications may be made of the invention without departing from its spirit. Therefore, it is intended that the scope of the invention be determined by the dependent claims and their equivalents.

INDUSTRIAL APPLICABILITY

The above described opening feature may be incorporated in any paperboard type carton wherein it is desired to provide a mechanism for gaining easy access to the contents of a carton. Further, the regions of weakness formed in accordance with the present invention may be formed in any paperboard type blank where it is desired to form a smooth line of separation within the paperboard blank. In addition, the described opening feature will be particularly useful for cartons for which protection of the contents from moisture or other liquids or gases is desired.

WHAT IS CLAIMED IS:

1. An opening device formed in a panel of a paperboard carton for facilitating the formation of an opening in said carton comprising:

an opening force receiving means adjacent said panel, at least one uncut line of weakness formed in an outer surface of said panel extending from said opening force receiving means adjacent one edge of the desired opening; and at least one cut line of weakness formed in said outer surface of said panel being substantially parallel to and spaced apart from said uncut line of weakness forming a region of weakness;

wherein a ply separation of said paperboard carton occurs at said region of weakness between said uncut line of weakness and said cut line of weakness when said opening force receiving means is drawn away from said carton.

2. An opening device as defined in claim 1, wherein said uncut line of weakness is a crease score line.

3. An opening device as defined in claim 2, wherein said crease score line is a sharp narrow crease score line formed by a forming die centered relative to a center line of a crease channel of a counter.

4. An opening device as defined in claim 2 wherein said crease score is a sharp narrow crease score line formed by offsetting a forming die relative to a centerline of a crease channel of a counter.

5. An opening device as defined in claim 1, wherein said uncut line of weakness is an embossed line.

6. An opening device as defined in claim 1 wherein said panel includes first and second side edges, a front edge and a rear edge and said opening force receiving means is a tab which extends from said front edge of said panel.

7. An opening device as defined in claim 6, wherein a pair of uncut lines of weakness are provided which extend from said front edge to said rear edge of said panel and a pair of cut lines of weakness are provided each extending substantially parallel to a respective one of said uncut lines of weakness forming a pair of regions of weaknesses with said cut line of weakness being positioned between said respective uncut line of weakness and a respective one of said side edges.

8. An opening device as defined in claim 7, wherein the respective regions of weakness converge towards one another from said front edge to said rear edge of said panel.

9. An opening device as defined in claim 1, wherein said cut line of weakness is cut 5% to 80% of the way through a thickness of said paperboard carton.

10. An opening device as defined in claim 9 wherein said cut line of weakness is cut approximately 50% of the way through said paperboard carton.

11. A carton blank formed of a paperboard material for forming a paperboard carton comprising;

a first panel having side walls connected thereto by scored fold lines formed between a respective side wall and a respective edge of said first panel;

a second panel having side walls connected thereto by scored fold lines formed between a respective side wall and a respective edge of said second panel, with one of said side walls of said first panel and one of said side walls of said second panel being congruent; and an opening means formed in said second panel for allowing access to the inside of a formed carton including;

an opening force receiving means adjacent said second panel;

at least one cut line of weakness formed in an upper surface of said second panel extending from said opening force receiving means and adjacent one of said respective edges of said second panel; and at least one uncut line of weakness formed in said upper surface of said second panel substantially parallel to and spaced apart from said cut line of weakness.

12. A carton blank as defined in claim 11 wherein said uncut line of weakness is a crease score line.

13. An opening device as defined in claim 12, wherein said crease score line is a sharp narrow crease score line formed by a forming die centered relative to a center line of a crease channel of a counter.

14. An opening device as defined in claim 12, wherein said crease score line is a sharp narrow crease score line formed by offsetting a forming die relative to a center line of a crease channel of a counter.

15. A carton blank as defined in claim 11 wherein said uncut line of weakness is an embossed line.

16. A carton blank as defined in claim 11 wherein said second panel includes a front edge, a rear edge and side edges; and said opening force receiving means is a tab which extends from said front edge.

17. A carton blank as defined in claim 16 wherein said second panel includes a pair of uncut lines of weakness and a pair of cut lines of weakness each extending substantially parallel to a respective one of said uncut lines of weakness forming a pair of said opening means with said cut line of weakness being formed between said respective one of said uncut lines of weakness and a respective one of said side edges.

18. A carton blank as defined in claim 17 wherein said pairs of opening means converge toward one another from said front edge to said rear edge of said second panel.

19. An opening device as defined in claim 11, wherein said cut line of weakness is cut 5% to 80% of the way through a thickness of said paperboard carton.

20. A carton blank as defined in claim 19, wherein said cut line of weakness is cut approximately 50% of the way through the thickness of said carton blank.

21. A carton for containing a product placed therein, said carton comprising;

a top wall;

a bottom wall;

side walls extending from said top wall to said bottom wall; and an opening means formed in one of said walls for allowing access to said product placed within said carton, including;

an opening force receiving means adjacent said one of said walls;

at least a first uncut line of weakness formed in an outer surface of said one of said walls and extending from said opening force receiving means; and at least a first cut line of weakness formed in an outer surface of said one of said walls substantially parallel to and spaced apart from said uncut line of weakness.

22. A carton as defined in claim 21 wherein said uncut line of weakness is a crease score line.

23. An opening device as defined in claim 22, wherein said crease score line is a sharp narrow crease score line formed by a forming die centered relative to a center line of a crease channel of a counter.

24. An opening device as defined in claim 22, wherein said crease score line is a sharp narrow crease score line formed by offsetting a forming die relative to a center line of a crease channel of a counter.

25. A carton as defined in claim 21 wherein said uncut line of weakness is an embossed line.

26. A carton as defined in claim 21 wherein said uncut line of weakness extends from said opening force receiving means to an edge of said wall.

27. A carton as defined in claim 21 wherein said opening means further includes a second uncut line of weakness extending from said opening force receiving means and a second cut line of weakness extending substantially parallel to said second uncut line of weakness with said first and second uncut lines of weakness are formed between said first and second cut lines of weakness on said one of said walls.

28. A carton as defined in claim 27, wherein said first and second uncut lines of weakness converge toward one another from said opening force receiving means to said edge of said one of said walls.

29. A carton as defined in claim 27, wherein said first and second cut lines of weakness are cut 5% to 80% of the way through a thickness of said carton.

30. A carton as defined in claim 29, wherein said first and second cut lines of weakness are cut approximately 50% of the way through said thickness of said carton.

31. A method of forming an uncut line of weakness in a surface of a paperboard blank comprising the steps of (a) providing a counter having a channel cut formed therein;

(b) providing a die having a crease rule;

(c) positioning the paperboard blank between said counter and said die;

(d) offsetting said crease rule of said die relative to a center line of said channel cut;

(e) pressing said crease rule of said die into said channel cut of said counter; wherein one edge of said line of weakness is pinched to a greater degree than the other edge of said line of weakness; and (f) forming a cut line of weakness substantially parallel to and spaced apart from said uncut line of weakness to form a region of weakness between said cut and said uncut lines of weakness.

32. A method as defined in claim 31, further comprising the step of forming the paperboard blank into a carton; wherein said region of weakness forms an opening means in a panel of said carton for gaining access to an interior of said carton.

33. A method as defined in claim 32, further comprising the step of forming a pair of said regions of weakness in said paperboard blank; whereby said pair of regions of weakness form said opening means.

34. A method as defined in claim 33, further comprising the step of forming an opening force receiving means adjacent said panel for aiding a consumer in opening said opening means.

35. A method as defined in claim 34, wherein said regions of weakness extend from said opening force receiving means and substantially parallel to one another.

36. A method as defined in claim 34, wherein said regions of weakness converge toward one another from said opening force receiving means to an edge of said panel.

* * * * *